US007605679B1

(12) United States Patent
Doane et al.

(10) Patent No.: US 7,605,679 B1
(45) Date of Patent: Oct. 20, 2009

(54) SYSTEM AND METHOD FOR PROVIDING A NON-PLANAR STRIPLINE TRANSITION

(75) Inventors: Jonathan P. Doane, Cedar Rapids, IA (US); Jeremiah D. Wolf, Cedar Rapids, IA (US); Lee M. Paulsen, Cedar Rapids, IA (US); Brian J. Herting, Marion, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 64 days.

(21) Appl. No.: 12/070,432

(22) Filed: Feb. 19, 2008

(51) Int. Cl.
*H01P 3/08* (2006.01)
*H01P 5/02* (2006.01)

(52) U.S. Cl. ..... 333/246; 333/34

(58) Field of Classification Search ..... 333/33, 333/34, 246, 260
See application file for complete search history.

(56) References Cited

U.S. PATENT DOCUMENTS 3,004,229 A * 10/1961 Stearns ..... 333/238
3,218,585 A * 11/1965 May ..... 333/246
3,806,767 A * 4/1974 Lehrfeld ..... 361/803
4,901,039 A * 2/1990 Corzine et al. ..... 333/1
5,334,800 A * 8/1994 Kenney ..... 174/250
6,441,697 B1 * 8/2002 Garland et al. ..... 333/34

* cited by examiner

*Primary Examiner*—Benny Lee
(74) *Attorney, Agent, or Firm*—Daniel M. Barbieri

(57) ABSTRACT

The present invention is a system including a first transmission line oriented in a first plane and a second transmission line oriented in a second plane. Both the first transmission line and the second transmission line include a pair of rigid substrate layers, a pair of flexible substrate layers and a trace portion, the trace portion being located between the pair of flexible substrate layers, the pair of flexible substrate layers being located between the pair of rigid substrate layers. The system further includes a transition transmission line which is connected between the first transmission line and the second transmission line. The transition transmission line includes a pair of flexible substrate layers and a trace portion, the trace portion of the transition transmission line being located between the pair of flexible substrate layers of the transition transmission line. The transition transmission line is configured for delivering energy from the first transmission line to the second transmission line and from the second transmission line to the first transmission line.

17 Claims, 3 Drawing Sheets

SYSTEM AND METHOD FOR PROVIDING A NON-PLANAR STRIPLINE TRANSITION

FIELD OF THE INVENTION

The present invention relates to the field of non-planar antennas and particularly to a system and method for providing a non-planar stripline transition.

BACKGROUND OF THE INVENTION

When designing non-planar antennas, it may be desirable to come up with a design which delivers energy from a first controlled impedance transmission line lying in a first plane to a second controlled impedance transmission line lying in a second plane. However, currently available solutions may be expensive, labor intensive, may result in a non-planar antenna array with a large board footprint, and/or may result in a non-planar antenna array which has limited reliability.

Thus, it would be desirable to provide a system/method for providing a transition in a non-planar antenna.

SUMMARY OF THE INVENTION

Accordingly, an embodiment of the present invention is directed to a non-planar antenna, including: a first transmission line oriented in a first plane, the first transmission line including a pair of rigid substrate layers, a pair of flexible substrate layers and a trace portion, the trace portion being located between the pair of flexible substrate layers, the pair of flexible substrate layers being located between the pair of rigid substrate layers; a second transmission line oriented in a second plane, the second transmission line including a pair of rigid substrate layers, a pair of flexible substrate layers and a trace portion, the trace portion of the second transmission line being located between the pair of flexible substrate layers of the second transmission line, the pair of flexible substrate layers of the second transmission line being located between the pair of rigid substrate layers of the second transmission line; and a transition transmission line, the transition transmission line being connected between the first transmission line and the second transmission line, the transition transmission line including a pair of flexible substrate layers and a trace portion, the trace portion of the transition transmission line being located between the pair of flexible substrate layers of the transition transmission line, wherein the transition transmission line is configured for delivering energy from the first transmission line to the second transmission line and from the second transmission line to the first transmission line.

An additional embodiment of the present invention is directed to a system, including: a first stripline transmission line oriented in a first plane, the first stripline transmission line including a pair of rigid substrate layers, a pair of flexible substrate layers and a trace portion, the trace portion being located between the pair of flexible substrate layers, the pair of flexible substrate layers being located between the pair of rigid substrate layers, wherein a ground plane for the first stripline transmission line is located on an exterior surface of at least one rigid substrate layer included in the pair of rigid substrate layers; a second stripline transmission line oriented in a second plane, the second stripline transmission line including a pair of rigid substrate layers, a pair of flexible substrate layers and a trace portion, the trace portion of the second stripline transmission line being located between the pair of flexible substrate layers of the second stripline transmission line, the pair of flexible substrate layers of the second stripline transmission line being located between the pair of rigid substrate layers of the second stripline transmission line, wherein a ground plane for the second stripline transmission line is located on an exterior surface of at least one rigid substrate layer included in the pair of rigid substrate layers of the second stripline transmission line; and a transition stripline transmission line, the transition stripline transmission line being connected between the first stripline transmission line and the second stripline transmission line, the transition stripline transmission line including a pair of flexible substrate layers and a trace portion, the trace portion of the transition stripline transmission line being located between the pair of flexible substrate layers of the transition stripline transmission line, wherein a ground plane for the transition stripline transmission line is located on an exterior surface of at least one flexible substrate layer included in the pair of flexible substrate layers of the transition stripline transmission line, wherein the transition stripline transmission line is configured for delivering energy from the first stripline transmission line to the second stripline transmission line and from the second stripline transmission line to the first stripline transmission line.

A further embodiment of the present invention is directed to a transition transmission line for connecting non-planar elements of a Radio Frequency (RF) system, including: a pair of flexible substrate layers, a ground plane for the transition transmission line being located on an exterior surface of at least one flexible substrate layer included in the pair of flexible substrate layers; and a trace portion, the trace portion being located between the pair of flexible substrate layers, wherein the transition transmission line is configured for connecting a first transmission line and a second transmission line, and is further configured for delivering energy from the first transmission line to the second transmission line and from the second transmission line to the first transmission line.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Figure 1:
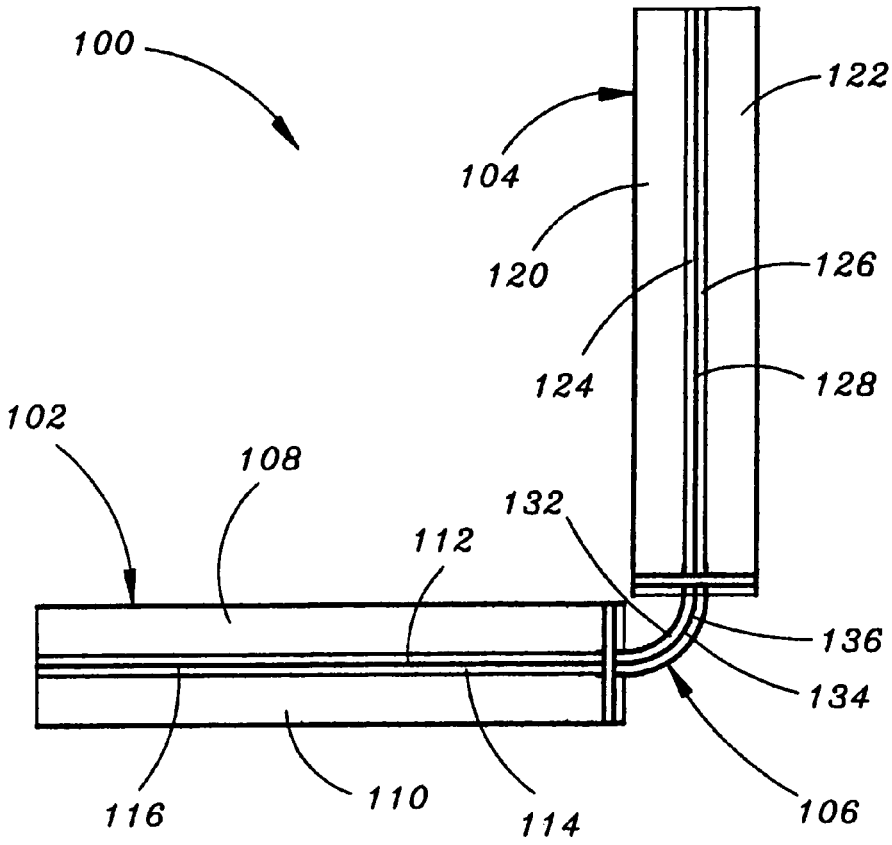
FIG. 1 is a cross-sectional view of a system for providing energy from a first transmission line to a second transmission line, the first and second transmission lines being non-planar with respect to one another in accordance with an exemplary embodiment of the present invention.
Figure 2:
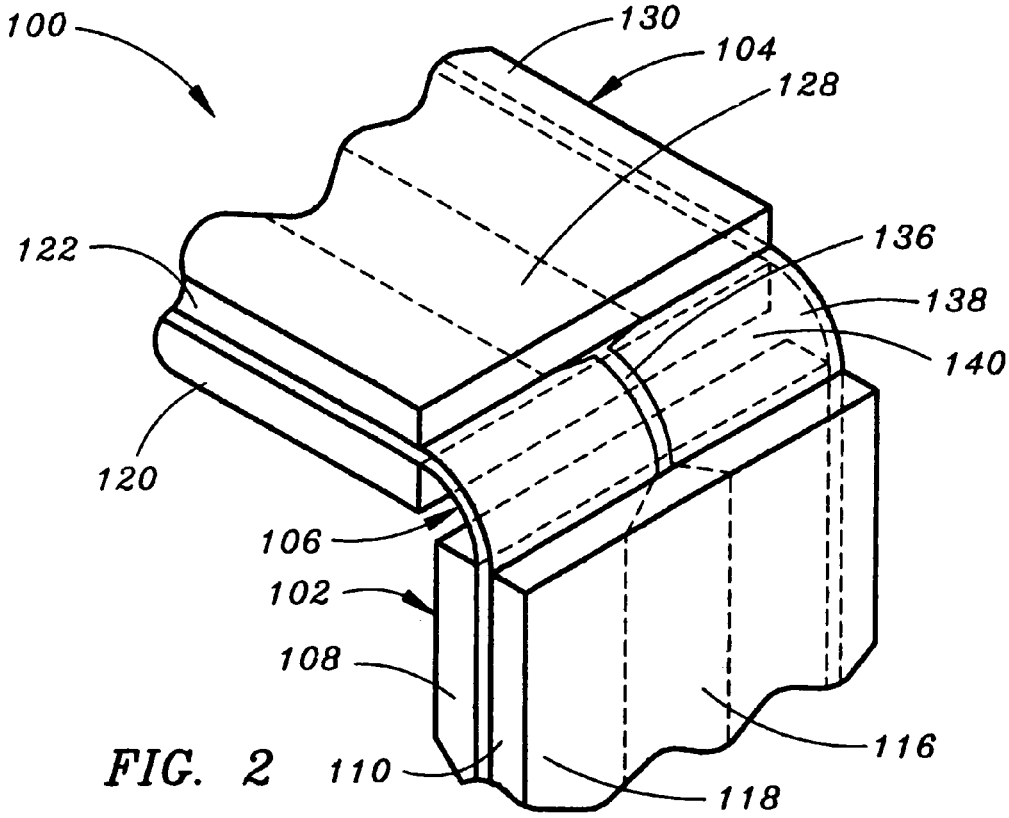
FIG. 2 is a close-up view of a system as shown in FIG. 1 in accordance with an exemplary embodiment of the present invention.

Referring generally to FIGS. 1 and 2, a system in accordance with an exemplary embodiment of the present invention is shown. For example, the system 100 may be/may be included as part of a non-planar antenna or non-planar antenna array/network, such as a Common Data Link (CDL) non-planar antenna or a mini-CDL non-planar antenna. In a current embodiment of the present invention, the system 100 includes a first transmission line 102 and a second transmission line 104. In an exemplary embodiment of the present invention, the first and second transmission lines (102, 104) may be controlled impedance transmission lines, such as stripline transmission lines. In further embodiments, the first transmission line 102 and the second transmission line 104 may be non-planar with respect to each other. For instance, the first transmission line 102 may be oriented in/along a first plane, while the second transmission line 104 may be oriented in/along a second plane. In the illustrated embodiment, the first transmission line 102 and the second transmission line 104 (and first plane and second plane respectively) are generally perpendicular with respect to each other, with the first transmission line 102 being oriented in/along a horizontal plane, and the second transmission line 104 being oriented in/along a vertical plane.

In a current embodiment of the present invention, the system 100 may further include a transition transmission line 106. The transition transmission line 106 may be configured for being physically and electrically connected between/for physically and electrically connecting the first transmission line 102 and the second transmission line 104. In exemplary embodiments, the transition transmission line 106 may be a controlled impedance transmission line, such as a stripline transmission line. The transition transmission line 106 may further be configured for delivering energy from the first transmission line 102 to the second transmission line 104, and for delivering energy from the second transmission line 104 to the first transmission line 102. For example, the energy delivered/directed through the first, second, and transition transmission lines (102, 104, 106) may be electrical energy and/or electromagnetic energy.

In an exemplary embodiment of the present invention, the first transmission line 102 may include a pair of rigid substrate layers (108 and 110). The first transmission line 102 may further include a pair of flexible substrate layers (112 and 114) as shown in FIG. 1. Still further, the first transmission line 102 may include a trace or trace portion 116, such as a stripline trace/stripline trace portion. In current embodiments of the present invention, the trace portion 116 is located/sandwiched/embedded/positioned between the pair of flexible substrate layers (112, 114), while the pair of flexible substrate layers (112, 114) are located/sandwiched/embedded/positioned between the pair of rigid substrate layers (108, 110). In further embodiments, a ground plane for the first transmission line 102 may be located on (an) exterior surface (s) 118 (see FIG. 2) of one or both of the rigid substrate layers (108, 110). In still further embodiments, the first transmission line 102 may be formed of rigid-flex circuit board materials (ex—may be formed as a horizontal combiner board assembly or a stripline stackup assembly).

In an additional embodiment of the present invention, the second transmission line 104 may include a pair of rigid substrate layers (120 and 122). The second transmission line 104 may further include a pair of flexible substrate layers (124 and 126). Still further, the second transmission line 104 may include a trace or trace portion 128, such as a stripline trace/stripline trace portion. In current embodiments of the present invention, the trace portion 128 is located/sandwiched/embedded/positioned between the pair of flexible substrate layers (124, 126) as shown in FIG. 1, while the pair of flexible substrate layers (124, 126) are located/sandwiched/embedded/positioned between the pair of rigid substrate layers (120, 122). In further embodiments, a ground plane for the second transmission line 104 may be located on (an) exterior surface (s) 130 (see FIG. 2) of one or both of the rigid substrate layers (120, 122). In still further embodiments, the second transmission line 104 may be formed of rigid-flex circuit board materials (ex—may be formed as one of a plurality of antenna vertical subarray panels).

In a current embodiment of the present invention, the transition transmission line 106 may include a pair of flexible substrate layers (132, 134) as shown in FIG. 1. The transition transmission line 106 may further include a trace or trace portion 136, such as a stripline trace/stripline trace portion. In current embodiments of the present invention, the trace portion 136 may be located/sandwiched/embedded/positioned between the pair of flexible substrate layers (132, 134). In further embodiments, a ground plane for the transition transmission line 106 may be located on (an) exterior surface(s) 138 (see FIG. 2) of one or both of the flexible substrate layers (132, 134). In still further embodiments, the transition transmission line 106 may be formed of rigid-flex circuit board materials. The transition transmission line 106, as it may be formed of only flexible materials (such as being formed of materials in which rigid material has been removed, leaving only flexible material) may be angled or bent, to accommodate/connect the non-planar first and second transmission lines (102, 104).

In exemplary embodiments of the present invention, the trace/trace portion 136 of the transition transmission line 106 may be sized and/or shaped for promoting minimization or reduction of reflected voltage and for maintaining a desired impedance. For instance, the trace/trace portion 136 of the transition transmission line 106 may be more narrow than the either the trace/trace portion 116 of the first transmission line 102 or the trace/trace portion 128 of the second transmission line 104 (ex—the trace portion 136 of the transition transmission line 106 may have a maximum width which is a lesser magnitude than either a maximum width of the trace portion 116 of the first transmission line 102 or a maximum width of the trace portion 128 of the second transmission line 104). Configuring the trace/trace portion 136 of the transition transmission line 106 in such a manner may compensate for the decreased height/thickness of the transition transmission line 106 compared to height/thickness of either the first transition transmission line 102 or the second transition transmission line 104 and may also compensate for impedance.

In further embodiments, the trace/trace portion 116 of the first transmission line 102, the trace/trace portion 128 of the second transmission line 104, and the trace/trace portion 136 of the transition transmission line 106 may be physically connected and/or electrically connected with each other. In additional embodiments, as shown in FIG. 2, the trace/trace portion 116 of the first transmission line 102 and the trace/trace portion 128 of the second transmission line 104 may be mitered/may have mitered corners proximal to their respective points of connection with the trace/trace portion 136 of the transition transmission line 106 to allow for capacitative junction compensation. In alternative embodiments, the system 100 of the present invention may implement a single, integral trace which connects and is established as part of the first transmission line 102, the transition transmission line 106 and the second transmission line 104.

Figure 3A:
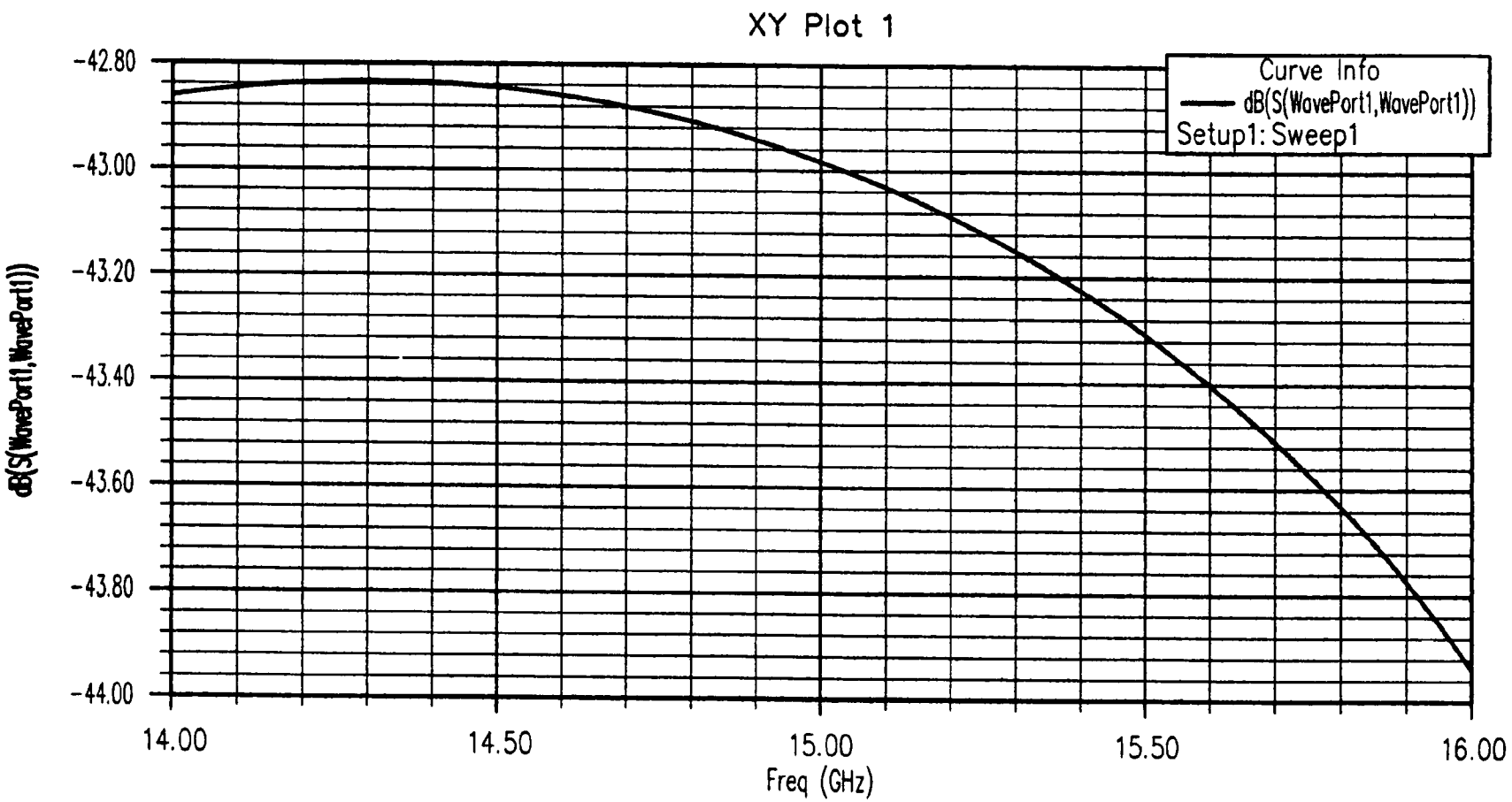
FIG. 3A is a graphical depiction of the performance of a transition transmission line in accordance with an exemplary embodiment of the present invention, the depiction illustrating Return Loss performance (as measured in decibels) over a particular frequency range of interest (as measured in GHz)
Figure 3B:
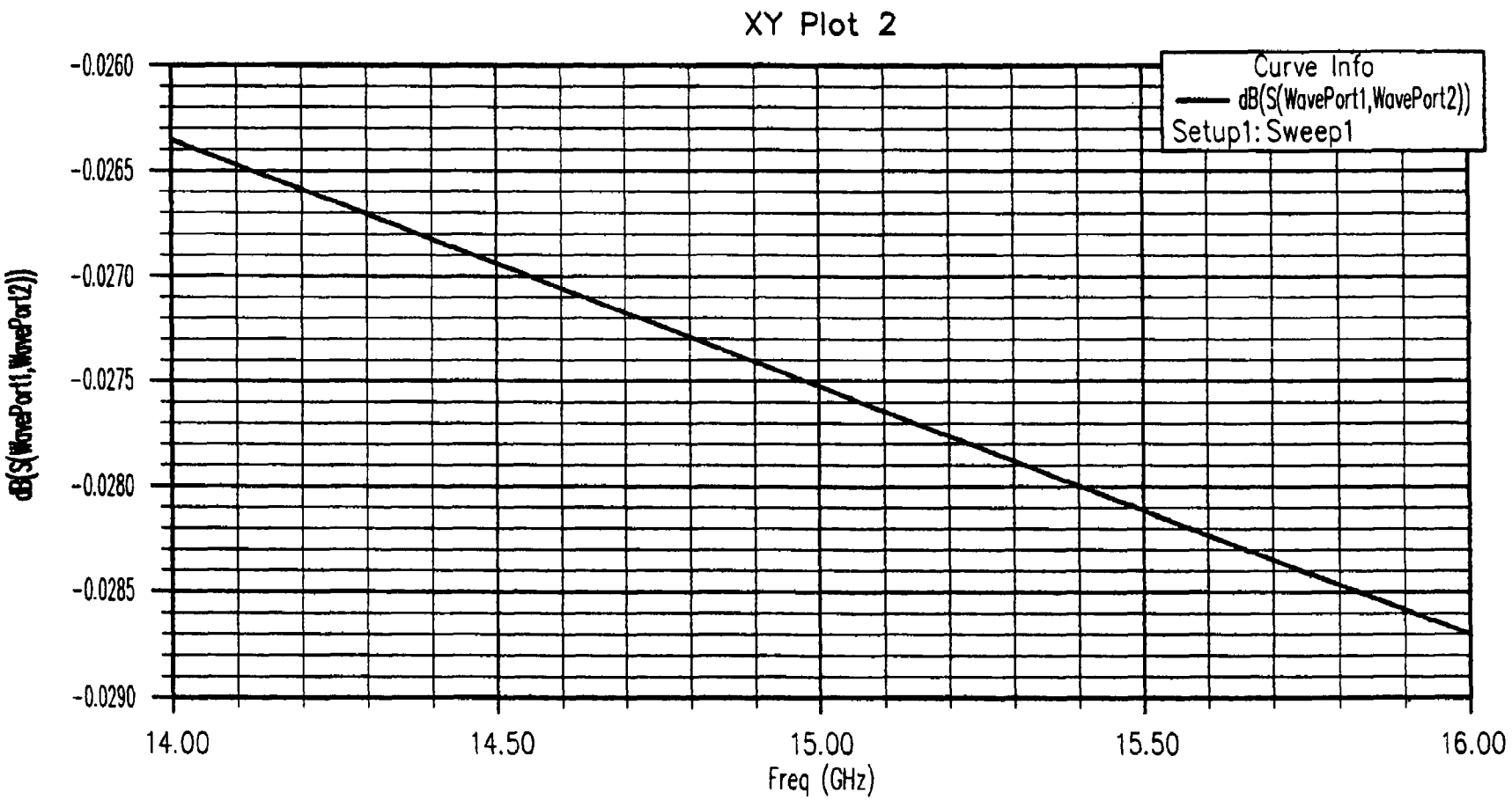
FIG. 3B is a graphical depiction of the performance of a transition transmission line in accordance with an exemplary embodiment of the present invention, the depiction illustrating Insertion Loss performance (as measured in decibels) over a particular frequency range of interest (as measured in GHz).

In additional embodiments, one or more vias 140 (see FIG. 2) may be formed within/through the pair of flexible substrate layers (132, 134) of the transition transmission line 106 for providing continuity of ground for the transition transmission line 106. The system 100 of the present invention provides a mechanism for delivering energy between two non-planar transmission lines which promotes reduced cost for parts/assembly, and reduced size/weight of the assembly. Further, the system 100 of the present invention promotes reduction in insertion loss for an exemplary transition transmission line 106 of the present invention. FIG. 3B is a graphical depiction of the insertion loss performance of a transition transmission line 106 in accordance with an exemplary embodiment of the present invention. In the depiction of FIG. 3B, insertion loss (as measured in decibels) for the exemplary transition transmission line 106 is slotted/measured over a particular frequency range of interest (as measured in GHz). Still further, FIG. 3A is a graphical depiction of the return loss performance (as measured in decibels) over a particular frequency range (as measured in GHz) for the exemplary transition transmission line 106 of the present invention. Still further, the system 100 of the present invention promotes reduction in Voltage Standing Wave Ratio (VSWR) compared to currently available solutions.

Aside from implementation in non-planar antennas, in further exemplary embodiments of the present invention, the above-described system 100 or any elements thereof may be/may be implemented as a part of any one of a number of various Radio Frequency (RF) systems which require interconnection of non-planar elements/require that a transition be provided for non-planar elements.

It is believed that the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A non-planar antenna, comprising:

a first transmission line oriented in a first plane, the first transmission line including a pair of rigid substrate layers, a pair of flexible substrate layers and a trace portion, the trace portion being located between the pair of flexible substrate layers, the pair of flexible substrate layers being located between the pair of rigid substrate layers;

a second transmission line oriented in a second plane, the second transmission line including a pair of rigid substrate layers, a pair of flexible substrate layers and a trace portion, the trace portion of the second transmission line being located between the pair of flexible substrate layers of the second transmission line, the pair of flexible substrate layers of the second transmission line being located between the pair of rigid substrate layers of the second transmission line, wherein the first plane is generally perpendicular to the second plane; and a transition transmission line, the transition transmission line being connected between the first transmission line and the second transmission line, the transition transmission line including a pair of flexible substrate layers and a trace portion, the trace portion of the transition transmission line being located between the pair of flexible substrate layers of the transition transmission line, wherein the transition transmission line is configured for delivering energy from the first transmission line to the second transmission line and from the second transmission line to the first transmission line.

2. A non-planar antenna as claimed in claim 1, wherein the first transmission line, the second transmission line, and the transition transmission line are each controlled impedance transmission lines.

3. A non-planar antenna as claimed in claim 2, wherein the first transmission line, the second transmission line, and the transition transmission line are each stripline transmission lines.

4. A non-planar antenna as claimed in claim 1, wherein the energy delivered is at least one of electrical energy and electromagnetic energy.

5. A non-planar antenna as claimed in claim 1, wherein a ground plane for the first transmission line is located on an exterior surface of at least one rigid substrate layer included in the pair of rigid substrate layers of the first transmission line.

6. A non-planar antenna as claimed in claim 1, wherein a ground plane for the second transmission line is located on an exterior surface of at least one rigid substrate layer included in the pair of rigid substrate layers of the second transmission line.

7. A non-planar antenna as claimed in claim 1, wherein a ground plane for the transition transmission line is located on an exterior surface of at least one flexible substrate layer included in the pair of flexible substrate layers of the transition transmission line.

8. A non-planar antenna as claimed in claim 1, wherein the trace portion of the first transmission line has a first maximum width, the trace portion of the second transmission line has a second maximum width, and the trace portion of the transition transmission line has a third maximum width, the third maximum width being a lesser magnitude than either the first maximum width or the second maximum width.

9. A non-planar antenna as claimed in claim 1, wherein the trace portion of the transition transmission line is sized and shaped for promoting minimization of reflected voltage.

10. A non-planar antenna as claimed in claim 1, wherein at least one of the first transmission line, the second transmission line, and the transition transmission line are comprised of rigid-flex circuit board materials.

11. A non-planar antenna as claimed in claim 1, wherein the trace portion of the transition transmission line is connected to the trace portion of the first transmission line and the trace portion of the second transmission line.

12. A non-planar antenna as claimed in claim 11, wherein the trace portion of the first transmission line is mitered proximal to a point of connection with the trace portion of the transition transmission line, and the trace portion of the second transmission line is mitered proximal to a point of connection with the trace portion of the transition transmission line.

13. A transition transmission line for connecting non-planar elements of a Radio Frequency (RF) system, comprising:

a pair of flexible substrate layers, a ground plane for the transition transmission line being located on an exterior surface of at least one flexible substrate layer included in the pair of flexible substrate layers;

a trace portion, the trace portion being located between the pair of flexible substrate layers, wherein the transition transmission line is configured for connecting a first transmission line and a second transmission line, the first transmission line being oriented in a first plane, the second transmission line being oriented in a second plane, the first plane being generally perpendicular to the second plane, the transition transmission line being further configured for delivering energy from the first transmission line to the second transmission line and from the second transmission line to the first transmission line.

14. A system, comprising:

a first stripline transmission line oriented in a first plane, the first stripline transmission line including a pair of rigid substrate layers, a pair of flexible substrate layers and a trace portion, the trace portion being located between the pair of flexible substrate layers, the pair of flexible substrate layers being located between the pair of rigid substrate layers, wherein a ground plane for the first stripline transmission line is located on an exterior surface of at least one rigid substrate layer included in the pair of rigid substrate layers;

a second stripline transmission line oriented in a second plane, the second stripline transmission line including a pair of rigid substrate layers, a pair of flexible substrate layers and a trace portion, the trace portion of the second stripline transmission line being located between the pair of flexible substrate layers of the second stripline transmission line, the pair of flexible substrate layers of the second stripline transmission line being located between the pair of rigid substrate layers of the second stripline transmission line, wherein a ground plane for the second stripline transmission line is located on an exterior surface of at least one rigid substrate layer included in the pair of rigid substrate layers of the second stripline transmission line, wherein the first plane is generally perpendicular to the second plane; and a transition stripline transmission line, the transition stripline transmission line being connected between the first stripline transmission line and the second stripline transmission line, the transition stripline transmission line including a pair of flexible substrate layers and a trace portion, the trace portion of the transition stripline transmission line being located between the pair of flexible substrate layers of the transition stripline transmission line, wherein a ground plane for the transition stripline transmission line is located on an exterior surface of at least one flexible substrate layer included in the pair of flexible substrate layers of the transition stripline transmission line, wherein the transition stripline transmission line is configured for delivering energy from the first stripline transmission line to the second stripline transmission line and from the second stripline transmission line to the first stripline transmission line.

15. A system as claimed in claim 14, wherein at least one of the first stripline transmission line, the second stripline transmission line, and the transition stripline transmission line are comprised of rigid-flex circuit board materials.

16. A system as claimed in claim 14, wherein the trace portion of the transition stripline transmission line is sized and shaped for promoting minimization of reflected voltage.

17. A system as claimed in claim 14, wherein the trace portion of the first stripline transmission line has a first maximum width, the trace portion of the second stripline transmission line has a second maximum width, and the trace portion of the transition stripline transmission line has a third maximum width, the third maximum width being a lesser magnitude than either the first maximum width or the second maximum width.

* * * * *